US005152105A

United States Patent [19]

Belvederi

[11] Patent Number: 5,152,105

[45] Date of Patent: Oct. 6, 1992

[54] DEVICE FOR SHARPENING ROTARY BLADES

[75] Inventor: Bruno Belvederi, San Martino di Monte San Pietro, Italy

[73] Assignee: G.D. Societa Per Azioni, Bologna, Italy

[21] Appl. No.: 620,058

[22] Filed: Nov. 30, 1990

[30] Foreign Application Priority Data

Dec. 1, 1989 [IT] Italy ..... 3739 A/89

[51] Int. Cl.[5] ..... B24B 49/00

[52] U.S. Cl. ..... 51/165.71; 51/165.74; 51/165.77; 51/109 BS; 76/85; 76/87; 76/89

[58] Field of Search ..... 51/108 BS, 109 BS, 111 R, 51/117, 118, 165.71, 165.74, 165.76, 246, 247, 248, 285; 76/85, 87, 89

[56] References Cited

U.S. PATENT DOCUMENTS

| | | | |
|---|---|---|---|
| 3,010,261 | 11/1961 | Rudszinat et al. . | |
| 4,584,917 | 4/1986 | Blon | 51/247 |
| 4,4593,705 | 6/1986 | Garthaffner | 131/84.4 |

FOREIGN PATENT DOCUMENTS

| | | | |
|---|---|---|---|
| 1173820 | 12/1969 | United Kingdom . | |
| 1311778 | 3/1973 | United Kingdom . | |
| 2123324 | 2/1984 | United Kingdom . | |
| 2169827 | 7/1986 | United Kingdom . | |
| 2214111 | 8/1989 | United Kingdom | 51/108 BS |

*Primary Examiner*—M. Rachuba
*Attorney, Agent, or Firm*—Cushman, Darby & Cushman

[57] ABSTRACT

A device for sharpening rotary blades driven about a fixed axis of rotation, as widely used in cigarette manufacturing machines, including a pair of mutually coaxial grinding wheels distanced one from the other, angled in relation to the plane occupied by the rotary blade, rotatable about a common axis and able to traverse toward and away from the blade. The grinding wheels are mounted to a shaft capable of movement through a rectilinear path parallel to the plane occupied by the blade and set in motion by a drive system interlocked to a monitoring and control medium that is automatic in operation and programmable according to the rate of wear or loss of cutting edge of the blade. Also forming a part of the device are sensors able to indicate when the blade is totally worn, i.e. when reduced to its minimum working diameter.

6 Claims, 2 Drawing Sheets

23
21
18
9
16
14
8a
10
4
8a
7
12
13
15
21
11
8
20
5
II
II
1a
1
19
6
22
3
17
2a
2

DEVICE FOR SHARPENING ROTARY BLADES

BACKGROUND OF THE INVENTION

The invention relates to a device for sharpening rotary blades, in particular for sharpening blades that turn about a fixed axis of rotation. Rotary blade cutting devices are utilized, more especially, in machines where there is a need for cuts to be effected faultlessly, without tearing the severed material.

Such is the case, for instance, with machines used in the manufacture of cigarettes, where the length of an initially formed cigarette rod constitutes a multiple of the length of the finished cigarette. Accordingly, the blades must be able to cut the multiple lengths into single cigarettes without in any way altering the cylindrical geometry of the product.

As experience has shown, only a slender, accurately sharpened blade is capable of ensuring the perfect cut.

To the end of restoring the cutting edge of rotary blades swiftly and correctly, sharpening devices of current design are envisaged as an integral part of the overall machine, one such device being located beside each rotary blade.

UK Patent 1 173 820 discloses a sharpening device consisting in a pair of grinding wheels disposed with axes parallel and angled in relation to the axis of rotation of the revolving blade. The wheels are convergently conical, and mounted freely to the opposite ends of a rocker pivoted centrally about a fulcrum afforded by one end of an arm, of which the remaining end is pivotably associated in turn with the support structure of the rotary blade assembly. The device comprises a first spring anchored at bottom to the top of the arm and secured uppermost to the support structure of the rotary blade, and a second spring anchored uppermost to the underside of the arm and made secure at bottom to a manual operating lever. The top spring thus functions as a flexible support for the grinding wheels whilst the lower spring cushions the approach of the wheels when offered to the rotary blade. The position of the wheels, angled in relation to the rotary blade, in combination with their conical profile, permits of sharpening the cutting edge to the prescribed bevel from both sides at once.

With this type of device it suffices, whenever the blade requires sharpening, to lower the operating lever by hand to the point where the wheels are brought into contact with the rotating edge, and once it is considered that a sufficient degree of sharpness is achieved, to release the lever.

Clearly enough, a device structured in this manner requires the continual presence of an operator to check on the condition of the rotary blade and to resharpen the edge at suitable intervals.

Where the machine or the equipment is fitted with a plurality of rotary blades, moreover, the operator has to keep a constant check on the sharpness of all the edges.

The task of the operator is complicated yet further where machines are equipped with several rotary blades cutting through different materials, for example filter rod and tobacco rod. In this case, the degree of wear or loss of cutting edge will not be the same for all blades, but variable according to the type of material; for example, the blades which cut through the tobacco rod lose their edge more quickly than those cutting through the filter rod, due to the presence of the tobacco.

In another sharpening device, described and claimed in U.S. Pat. No. 3 010 261, the paired grinding wheels are carried by a sleeve rotatably ensheathing and axially slidable along a mandrel disposed skew in relation to the axis of rotation of the blade. The mandrel is accommodated and restrained internally of the bore of an adjustment sleeve mounted to a supporting bracket, the bracket being embodied in two parts, in such a way as permits of varying the angular position of the adjustment sleeve, hence also the bringing wheels, in relation to the axis of rotation of the blade. The grinding wheels are distanced one from the other in such a way that the rotary blade can be accommodated between them and its cutting edge thus ground from both sides. The wheels are adjusted for position by manipulating the parts of the supporting bracket, rotating the one movable part in relation to the other fixed part, about respective axes.

With this second device, the operator can position the sharpening wheels in relation to the rotating blade and place them in permanent contact with the cutting edge, whereupon the device can be left to operate unminded as the position of the wheels will remain stable. The mandrel is in fact secured by means of clamp bolts, though this tends to lengthen the positioning operation.

SUMMARY OF THE INVENTION

An object of the present invention is to provide a sharpening device of which the grinding wheels can be positioned correctly, swiftly and stably in relation to a rotary blade.

A further object of the present invention is to provide a sharpening device that does not require constant minding on the part of an operator.

The stated objects are realized according to the invention in a sharpening device for rotary blades, in particular blades that turn about a fixed axis of rotation, comprising a pair of mutually coaxial grinding wheels distanced one from the other in such a way as to afford a recess accommodating at least the cutting edge of a blade to be sharpened, which are angled in relation to the plane occupied by the blade, rotatable about their common axis and capable of movement toward and away from the blade. In such a device, the grinding wheels are mounted to a respective support capable of movement through a rectilinear trajectory parallel with the plane occupied by the blade, and set in motion, at least when moving toward the blade, by respective drive means interlocked to monitoring and control means that are automatic in operation and programmable according to the rate of wear or loss of cutting edge of the rotary blade.

The device also comprises sensing means serving to indicate the totally worn condition of the cutting edge, which corresponds in practice to the minimum working diameter of the blade.

BRIEF DESCRIPTION OF THE DRAWINGS

The invention will now be described in detail, by way of example, with the aid of the accompanying drawings, in which:

FIG. 33 is a frontal elevation of cam means forming part of the device.

DESCRIPTION OF THE PREFERRED EMBODIMENTS

Figure 1:
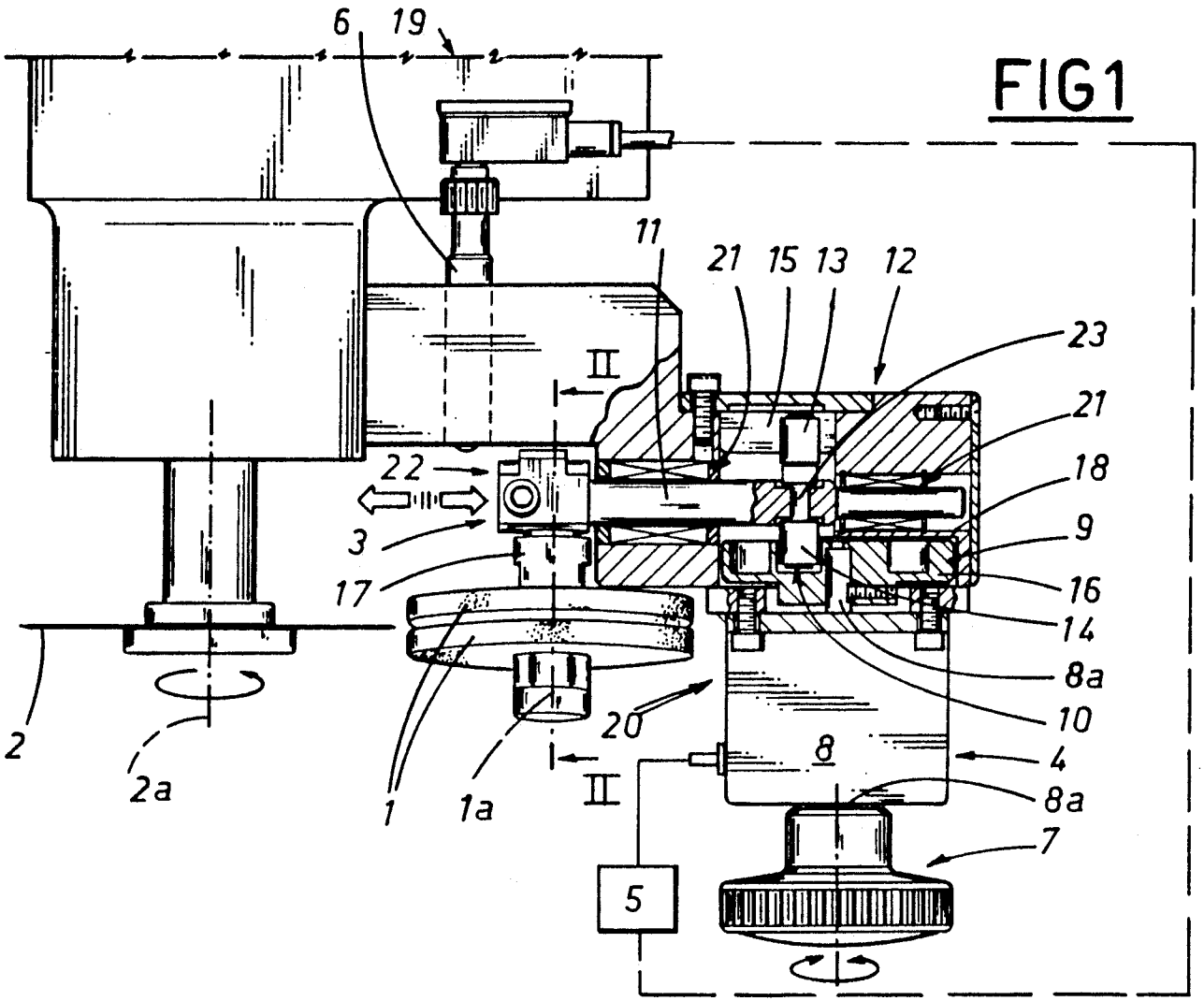
FIG. 1 illustrates a sharpening device according to the present invention, viewed in plan with certain parts cut away better to reveal others.
Figure 2:
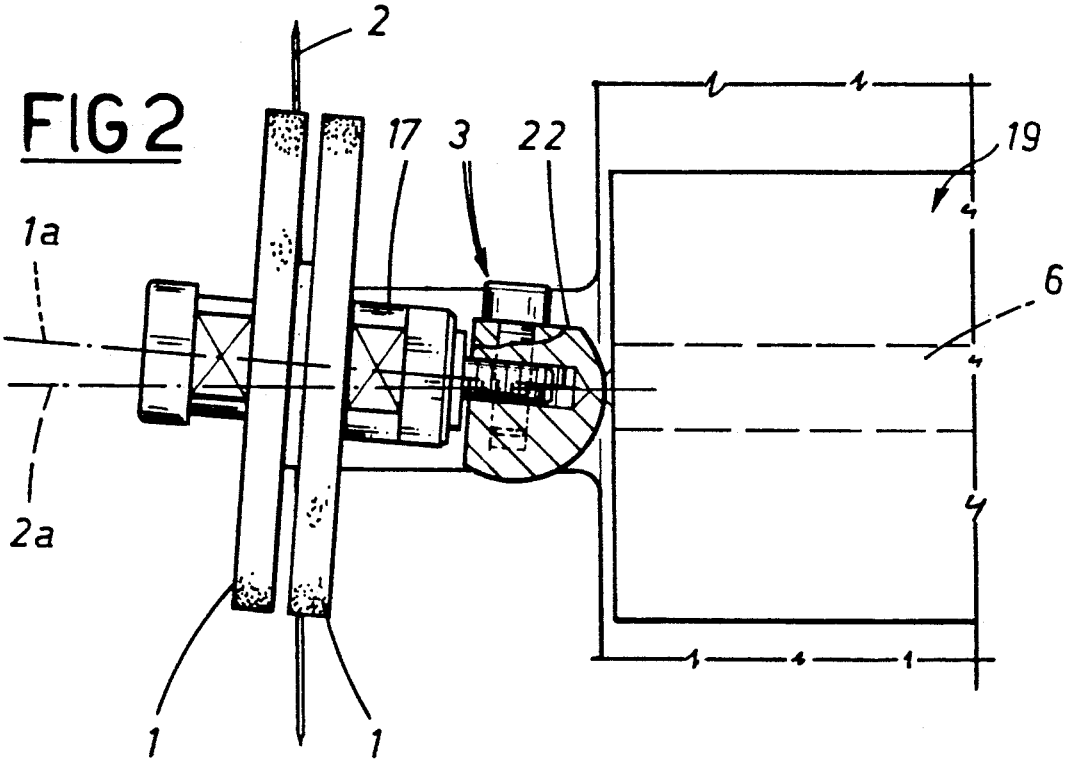
FIG. 2 is the section through II—II, FIG. 1.

With reference to the above drawings, 20 denotes a device, in its entirety, serving to sharpen rotary blades 2 turning about a fixed axis of rotation, as used, particularly, in cigarette-making machines.

The sharpening device 20, permanently associated with a structure 19 by which the rotating blade 2 is supported, consists essentially in a pair of mutually coaxial grinding wheels 1 freely rotatable about a common axis 1*a* and mounted to a support 3 capable of movement along a rectilinear trajectory. The wheels 1 are disposed with their common axis 1*a* angled in relation to the axis of rotation 2*a* of the blade 2, and are distanced one from the other in such a way as to create a recess accommodating at least the cutting edge of the blade 2. The angle between the two axes 1*a* and 2*a* is such that the two opposite sides of the cutting edge of the blade 2 will make contact with the respective wheels 1 at angles precisely symmetrical to one another.

The support 3 is set in motion by drive means 4 interlocked to monitoring and control means 5 that are automatic in operation, and programmable on the basis of the amount of wear or the loss of cutting edge to which the blade 2 is subject.

More exactly, such monitoring and control means 5 are programmed on the basis of an amount of wear or loss of cutting edge to which it is envisaged that the blade 2 will be subject when operating with a given material.

The device 20 further comprises sensing means 6 capable of indicating the totally worn condition of the blade 2, which coincides in practice with the specified minimum working diameter of the blade.

With explicit reference now to the embodiment shown by way of example in the accompanying drawings, the freely revolving grinding wheels 1 are mounted to a common spindle 17 of which the axis 1*a* is angled in relation to the axis 2*a* of rotation of the blade 2. The support 3 comprises a bearer element embodied as a shaft 11 axially slidable and freely rotatable within a socket 18 afforded by a structure 12 that is fixed in relation to the supporting structure 19 carrying the blade 2. The shaft 11 is ensheathed by respective anti-friction means denoted 21, favoring its axial sliding motion in relation to the fixed structure 12, and disposed with its axis normal to the axis 2*a* of rotation of the blade 2.

The spindle 17 is attached at one end to the end of the shaft 11 nearest to the rotary blade 2, by way of a clamp fitting 22 that permits of adjusting the position of the spindle 17, hence of the wheels 1, about the axis of the shaft 11, for reasons that will become apparent in due course.

Figure 3:
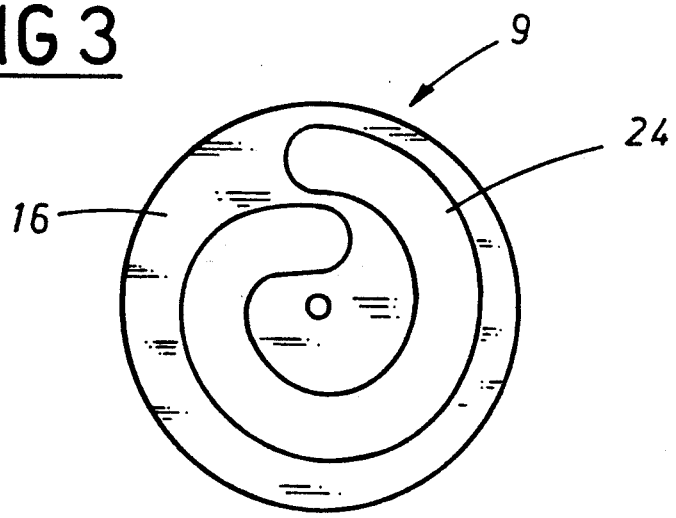

The numeral 23 denotes a pin passing diametrically through the shaft 11 at an intermediate point along its length, of which one end carries a freely revolving roller denoted 13, capable of movement internally of a respective rectilinear channel 15 afforded by the fixed structure 12 and disposed parallel to the axis of the shaft 11. Constrained internally of and in rolling contact with the rectilinear channel 15, the roller 13 allows the shaft 11 freedom of axial movement while preventing it from rotating about its own axis. In short, the roller 13 serves to ensure that the angle of the spindle 17, selected and made secure with the clamp fitting 22, remains constant during axial movement of the shaft 11. Drive means 4 comprise a stepping motor 8, and cam means 9 (see FIG. 3) designed to interact with cam follower means 10 associated with the shaft 11. More exactly, cam means 9 are embodied as a disk 16 keyed to the shaft 8*a* of the stepping motor 8 and affording a cam-profiled groove 24. Cam follower means 10 are embodied as a second roller 14 mounted freely to the end of the pin 23 opposite from the end with which the freely revolving roller 1 first mentioned is associated, and accommodated slidably in the groove 24 of the disk 16. The cam groove 24, as discernible from FIG. 3, exhibits a substantially spiral geometry and is disposed in such a way that the roller 14 can be distanced from or drawn toward the axis of the disk 16 during its rotation.

The numeral 7 denotes manual adjustment means, embodied as a knob, associated with the shaft 8*a* of the stepping motor 8.

The monitoring and control means 5 are programmed, for example, to pilot a predetermined number of steps of the motor 8 in a given interval of time. The sensing means 6 are connected to the monitoring and control means 5, and activated by proximity of the clamp fitting 22 on its arrival in a position substantially facing the sensing means 6.

With a sharpening device 20 thus embodied, a first step during installation is that of selecting the angle of the axis 1*a* of the grinding wheels 1 in relation to the axis 2*a* of rotation of the blade 2, by setting and securing the clamp fitting 22.

A blade 2 worn beyond further use is rendered free of obstruction by distanced the grinding wheels 1, and duly removed from the supporting structure 19. The replacement blade 2 is then fitted and set in rotation about its axis 2*a*, whereupon the knob 7 is used to position the grinding wheels 1 against the cutting edge.

The moment that the wheels 1, mounted loosely to the spindle 17, are set in rotation by entering into contact with the blade 2, the knob 7 will be released and the monitoring and control means 5 activated. Having been reset to their start-cycle configuration, the monitoring and control means 5 will now relay a periodic control signal to the stepping motor 8 at programmed intervals, i.e. at a frequency suitable for the material the blade 2 is designed to cut, thus piloting a prescribed angular movement the motor shaft 8*a*.

When the sensing means 6 are activated ultimately by the clamp fitting 22, these will relay a signal to the monitoring and control means 5 inhibiting any further approach of the grinding wheels 1 and triggering activation of a signal to indicate the totally worn state of the blade 2.

Thus, it will be seen that the stated objects are comprehensively realized with a sharpening device according to the invention, insofar as the presence of an operator is required only at the moment of replacing the rotary blade 2. Moreover, with the type of feed drive adopted, i.e. stepping motor 8, cam 9 and follower 10, the grinding wheels 1 can be inched through distances that would be impossible for an operator to judge without the aid of complex and costly transmission devices.

This micrometric following action of the wheels 1 permits of subjecting the blade 2 to what is almost a stepless sharpening action, thereby guaranteeing a faultless cut for the full life of the blade 2. Furthermore, programmable monitoring and control means 5 provide the facility of varying the duty cycle of the stepping motor 8, i.e. frequency and duration, to suit the cut material, hence to offset the faster or slower rate at which the cutting edge of the rotating blade 2 becomes dulled.

In an alternative embodiment of the sharpening device, the monitoring and control means 5 might be programmable not merely in respect of an envisaged amount of wear or loss of cutting edge to which it is supposed that the blade 2 will be subject, but directly in response to the degree of wear on the blade 2 that occurs in practice. Accordingly, means might be incorporated (not illustrated) by which to sense the wear or loss of cutting edge effectively registering at the blade 2, consisting in means that will sense the variation in angular velocity of the grinding wheels 1 caused by a partial loss of grip with the cutting edge of the blade 2.

What is claimed:

1. A device for sharpening a cutting edge of a planar rotary blade turning about a fixed axis of rotation, as utilized in cigarette manufacturing machinery and having a known typical rate of wear when used for cutting a particular material, said device comprising:

a pair of mutually coaxial grinding wheels set at a distance one from the other such as to afford a recess accommodating at least the cutting edge of a blade to be sharpened, said grinding wheels being angled in relation to the plane occupied by the blade, said grinding wheels being rotatable about their common longitudinal axis;

a support capable of movement through a rectilinear trajectory parallel with the plane occupied by the blade, said grinding wheels being mounted to said support for movement therewith;

drive means, by which said grinding wheel support is set in motion along said trajectory at least when moving toward the blade;

monitoring and control means, programmable in respect of said known typical rate of wear or loss of cutting edge of the rotary blade and automatic in operation, to which the drive means are interlocked for setting said grinding wheel support in motion depending upon said known typical rate of wear or loss of cutting edge, in accordance with a program residing in said monitoring and control means, said monitoring and control means further including means designed to sense a totally worn condition of the rotary blade and thereupon to inhibit operation of the drive means, wherein the totally worn condition corresponds to the minimum working diameter of the blade.

2. A sharpening device as in claim 1, comprising manually operated means, associated with the drive means interlocked to the programmable automatic monitoring and control means, by which the grinding wheel support can be set in motion along its rectilinear trajectory, at least in the direction whereby the grinding wheels are moved toward the rotary blade, during initial adjustment of the device.

3. A sharpening device as in claim 1, wherein drive means comprise a stepping motor, and cam means keyed to the shaft of the motor and interacting with cam follower means associated permanently with the support to which the two grinding wheels are mounted.

4. A sharpening device as in claim 1, wherein the support to which the grinding wheels are mounted comprises a shaft disposed with its longitudinal axis parallel to the plane occupied by the rotary blade, supported by and axially slidable in relation to a fixed structure, and drive means comprise a stepping motor, cam means keyed to the shaft of the stepping motor, and cam follower means associated permanently with the shaft and interacting with the cam means.

5. A sharpening device as in claim 4, comprising two freely revolving rollers carried by the support shaft, of which one is accommodated internally of a rectilinear channel afforded by the fixed structure and disposed parallel with the axis of the shaft, and the other internally of a profiled groove afforded by a disk keyed coaxially to the shaft of the stepping motor, wherein the disk and the relative freely revolving roller provide the cam means and the cam follower means, respectively.

6. A sharpening device as in claim 1, wherein the support to which the grinding wheels are mounted is set in motion by the drive means through said rectilinear trajectory.

* * * * *